US007255159B2

(12) United States Patent
Sagasser et al.

(10) Patent No.: US 7,255,159 B2
(45) Date of Patent: Aug. 14, 2007

(54) INSERT FOR HEAT EXCHANGER TUBE

(75) Inventors: Rob J. Sagasser, AR Uden (NL); Jens Blütling, Stuttgart (DE); Rainer Käsinger, Haiterbach (DE)

(73) Assignee: Modine Manufacturing Company, Racine, WI (US)

( * ) Notice: Subject to any disclaimer, the term of this patent is extended or adjusted under 35 U.S.C. 154(b) by 20 days.

(21) Appl. No.: 10/772,067

(22) Filed: Feb. 4, 2004

(65) Prior Publication Data

US 2004/0177668 A1 Sep. 16, 2004

(30) Foreign Application Priority Data

Feb. 6, 2003 (DE) ..... 103 04 692

(51) Int. Cl.
*F28F 1/40* (2006.01)
*F28F 13/08* (2006.01)
*F28F 13/12* (2006.01)

(52) U.S. Cl. ..... 165/177; 165/109.1; 165/146; 165/166; 165/916

(58) Field of Classification Search ..... 165/109.1, 165/146, 153, 183, 916, 166; 138/38
See application file for complete search history.

(56) References Cited

U.S. PATENT DOCUMENTS 3,016,921 A * 1/1962 Tadewald ..... 138/38
3,083,662 A * 4/1963 Zeidler ..... 138/38
3,542,124 A * 11/1970 Manfredo et al. ..... 165/166
3,992,168 A * 11/1976 Toyama et al. ..... 165/166
4,049,051 A * 9/1977 Parker ..... 165/166
4,815,532 A * 3/1989 Sasaki et al. ..... 165/153
6,244,334 B1 * 6/2001 Wu et al. ..... 165/153
6,273,183 B1 * 8/2001 So et al. ..... 165/109.1

FOREIGN PATENT DOCUMENTS

DE 29622191 3/1997
EP 0742418 4/1996
JP 04335993 A * 11/1992

* cited by examiner

*Primary Examiner*—Leonard R. Leo
(74) *Attorney, Agent, or Firm*—Michael Best & Friedrich LLP

(57) ABSTRACT

An insert adapted to connect to opposite walls in a heat exchanger tube, including a corrugated sheet having alternating wave crests and wave troughs connected by wave flanks having openings therein, wherein at least some of the wave crests have a length different than the length of the wave troughs, and/or adjacent sections have different wavelength waves. Such inserts may be produced by transporting material sheets through a press, where the sheet feed rate and/or the press stroke speed may be selectively varied.

3 Claims, 2 Drawing Sheets

INSERT FOR HEAT EXCHANGER TUBE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward inserts for corrugated heat exchanger tubes, and particularly toward turbulators and methods of producing same.

BACKGROUND OF THE INVENTION AND TECHNICAL PROBLEMS POSED BY THE PRIOR ART

Heat exchangers typically provide separate flow paths for different media, with heat being exchanged between the media through the materials separating the flow paths. For example, in radiators, a plurality of tubes are commonly provided for carrying heated fluid, with air blown over the tubes (and fins attached to the tubes) so that heat from the fluid is dissipated through the tube walls (and attached fins) to the air, thereby cooling the fluid.

It is important that the flow paths in such heat exchangers facilitate such heat exchange by, for example, maximizing the heat dissipation to the tube walls of the fluid flowing therein, while also minimizing pressure drop in the fluid so as to ensure proper flow of the fluid through the heat exchanger and in the system in which the fluid may be used.

Corrugated inserts or turbulators have been used to facilitate such desired operation. In one example having a corrugated insert in a heat exchanger tube of an oil cooler, the insert has uniform waves with openings in the wave flanks. With such inserts, as indicated in German Utility Model DE 296 22 191 or European Patent EP 742 418 B1, an inflow direction favorable for low pressure loss of the oil lies across the wave trend with an unfavorable one lying precisely in the wave trend. Such inserts can therefore be inserted into the heat exchanger tube so that the wave trend has a certain slope relative to the inflow direction to provide an optimal ratio of cooling performance to pressure loss. However, it is necessary that such inserts be punched out with the corresponding slope angle, so that higher material wastage could possibly occur. Since this is not willingly accepted, in terms of achieving the optimal ratio of cooling performance to pressure loss, relatively large bypasses are often left between the edges of the heat exchanger tube and the edges of the insert. However, such bypasses effect the overall flow characteristics of the heat exchanger and they are therefore often not desirable.

In other heat exchangers such as in flat tubes of charge air coolers or condensers, inserts have been arranged in the heat exchanger tubes so that the inflow direction is situated precisely across the wave trend, in which case openings in the wave flanks need not necessarily be present. However, the advantages of heat exchange provided by fluid flow through multiple wavelengths (through flank openings) are also not received.

The present invention is directed toward overcoming one or more of the problems set forth above.

SUMMARY OF THE INVENTION

In one aspect of the present invention, an insert which is adapted to connect to opposite walls in a heat exchanger tube is provided, the insert comprising a corrugated sheet having alternating wave crests and wave troughs connected by wave flanks having openings therein, wherein at least some of the wave crests have a length different than the length of the wave troughs.

In one form of this aspect of the present invention, the length of some wave crests is one of either at least twice or no more than one half the length of the wave troughs.

In another form of this aspect of the present invention, the waves of the corrugated sheet have a selected height.

In another aspect of the present invention, a method of producing the above insert is provided, including (a) transporting a sheet metal strip at a specific feed rate and specific advance through a deformation die on an eccentric press that operates with continuous stroke operation, (b) selectively changing one of the feed rate and continuous stroke speed. At a constant continuous stroke speed, the feed rate when reduced forms crest or trough lengths less than when the feed rate is increased, and at a constant continuous feed rate, the continuous stroke speed when reduced forms crest or trough lengths greater than when the continuous stroke speed is increased.

In one form of this aspect of the present invention, continuous stroke operation is interrupted during continuous feed of the metal strip to form a section having one of either no waves or a single long drawn-out wave.

In still another aspect of the present invention, an insert adapted to connect to opposite walls in a heat exchanger tube is provided, including a corrugated sheet having alternating wave crests and wave troughs connected by wave flanks having openings therein, the insert having a first section having a first wavelength and a second section having a second wavelength, the first section being adjacent the second section and the first wavelength being is less than the second wavelength.

In one form of this aspect of the present invention, a third section has a third wavelength, the second section is between the first and third sections, and the second wavelength is greater than the first and third wavelengths.

In another form of this aspect of the present invention, a heat exchanger medium inlet opening is provided in the first section and a heat exchanger medium outlet opening is provided in the third section, wherein the first and third wavelengths are substantially the same.

In yet another aspect of the present invention, a method of producing an insert according to the still another aspect of the invention is provided, including (a) transporting a sheet metal strip at a specific feed rate and specific advance through a deformation die on an eccentric press that operates with continuous stroke operation, and (b) selectively changing one of the feed rate and continuous stroke speed. At a constant continuous stroke speed, the feed rate when reduced forms the first section and the feed rate when increased forms the second section, and at a constant continuous feed rate, the continuous stroke speed when reduced forms the second section and the continuous stroke speed when increased forms the second section.

In one form of this aspect of the present invention, continuous stroke operation is interrupted during continuous feed of the metal strip to form a section having one of either no waves or a single long drawn-out wave.

DETAILED DESCRIPTION OF THE INVENTION

Figure 5:
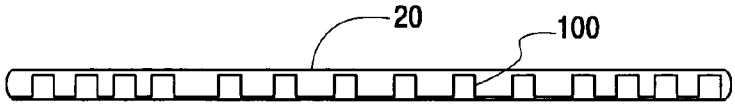
FIG. 5 is a side, cross-sectional view illustrating the insert of FIGS. 4*a*–4*b* in a tube.

The present invention concerns a corrugated insert 10 which may be inserted into a heat exchanger tube 20 (see FIG. 5).

It should be understood that the present invention could be advantageously used in connection with many different heat exchanger configurations. Thus, the heat exchanger tube with which inserts according to the present invention may be used may be arbitrarily designed according to the requirements of the heat exchanger, with the inserts 10 designed in accordance with the tube design. For example, the heat exchanger tube 20 may be a welded, soldered or drawn flat tube, as may be used, for example, in air-cooled charge air coolers.

For illustration purposes herein, the present invention is described with reference to practical examples which refer to the insert in a heat exchanger tube of an oil-cooler such as shown, for example in European Patent EP 742 418 B1, the full disclosure of which is hereby incorporated by reference. Particularly, reference is made herein to heat exchanger tubes which consist, for example, of two tube shells inserted one on the other, tightly soldered on their edge to delimit the space in which the insert is situated, each shell defining opposite spaced walls functioning as heat exchange surfaces. Such exemplary heat exchanger tubes have at least one inlet opening and an outlet opening, whereby oil may flow through the tube from the inlet opening to the outlet opening. Cooling fluid may flow over the outer surfaces of the walls for heat exchange therebetween.

Figure 1:
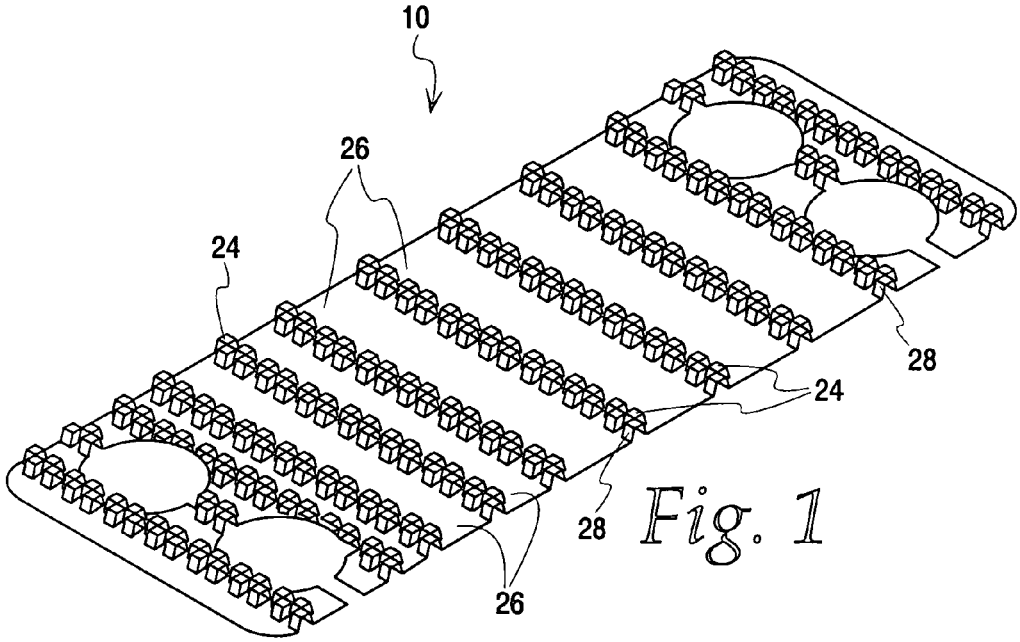
FIG. 1 is a perspective view of an insert embodying the present invention.

FIG. 1 illustrates one embodiment of an insert 10 according to the present invention, including alternating wave crests 24 and wave troughs 26 connected by flanks 28. Suitable openings 30 (see FIG. 2) may advantageously be provided in the flanks 28 to allow oil or coolant to pass through, and the crests 24 and troughs 26 may advantageously be metallically connected to the walls of the heat exchanger tube 20.

Figure 2:
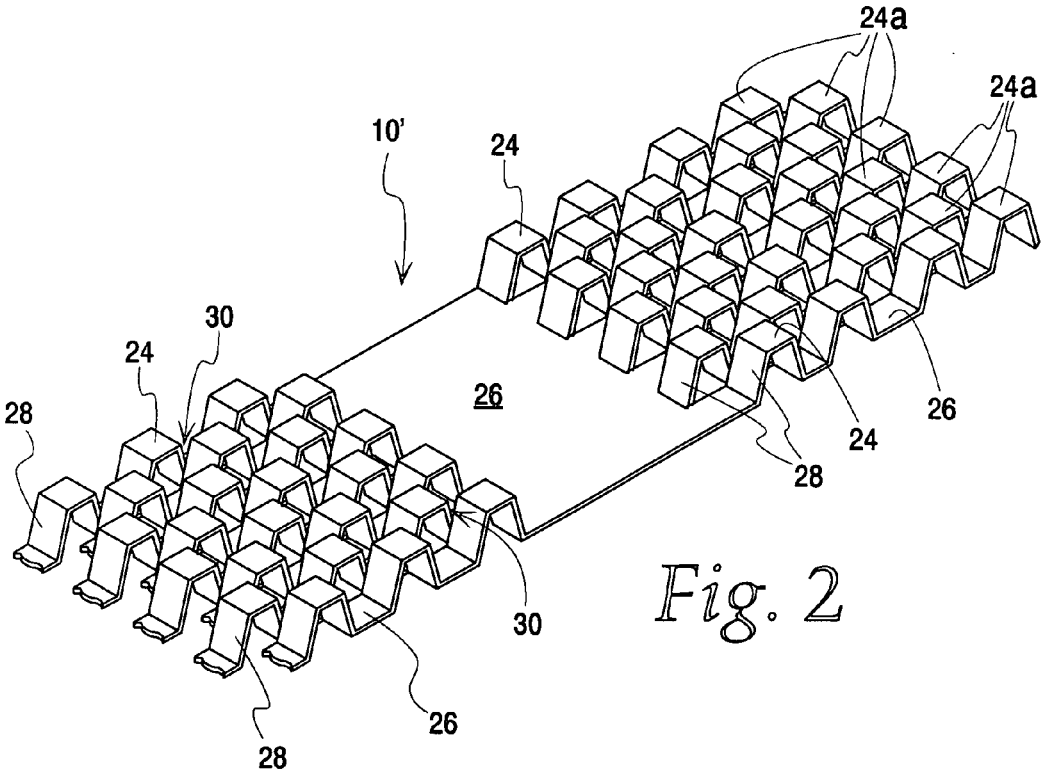
FIG. 2 is an enlarged perspective view illustrating exemplary waves which may be used in accordance with the present invention.

The insert 10 further has a selected wave height 36 and wavelength (spacing) 38 as discussed in further detail hereafter. Note that, as best illustrated in FIG. 2, a single "wave" comprising a crest 24 and trough 26 may be defined unevenly laterally across the insert 10', whereby the uneven arrangement defines the flank openings 30. Thus, the eight crests 24*a* at the upper right of FIG. 2 may be said to comprise a single "wave".

Further, it should be understood that references to wave crests and wave troughs are for convenience only, and that the "crests" could be as well characterized as troughs and the "troughs" characterized as crests. As such, uses of "trough" and "crest" herein are not limited to wave bottoms and wave tops according to the common usage of those terms, but rather are intended to refer only to opposite extremes of the general wave form.

The wave trend 40 of the insert 10 agrees roughly with the inflow direction 44 (see FIG. 3*b*), so that oil or coolant must flow through the openings 30 in order to reach the next wave from another wave or from the inlet opening 50 to the outlet opening 52.

For convenience of illustration, it should be noted that simplified waveforms are illustrated in the embodiments of FIGS. 3*a*–6, with the waveforms illustrated as straight without flank openings. It should be recognized, that the waveforms in FIGS. 3*a*–6 could be generally of the configurations shown in the perspective views of FIGS. 1–2. It should also be recognized, however, that the waveforms need not have flank openings at all in some applications (e.g., if the inflow direction, rather than agreeing roughly with the wave trend, is generally perpendicular to the wave trend).

In accordance with the present invention, desired ratios of cooling power to pressure loss may be obtained with the insert 10 having wave troughs 26 which have a greater length than the wave crests 24. That is, in the FIGS. 3*a*–*b* embodiment insert 10", in each wavelength 38 (i.e., the spacing between crests or troughs), the length 56 of the wave trough 26 is roughly twice the length 58 of the wave crest 24. It should thus be understood that the pressure loss can be reduced by the fact that oil and/or coolant on the way from inlet opening 50 to outlet opening 52 may overcome fewer waves or openings 24 than in inserts with uniform length waves and troughs according to the prior art.

Figure 4A:
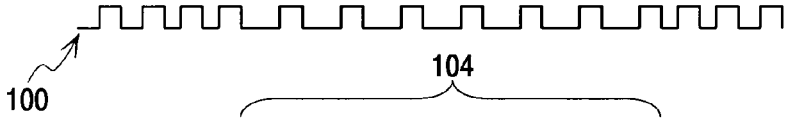
FIGS. 4*a*–4*b* are side and top views of another embodiment of an insert according to the present invention.
Figure 4B:
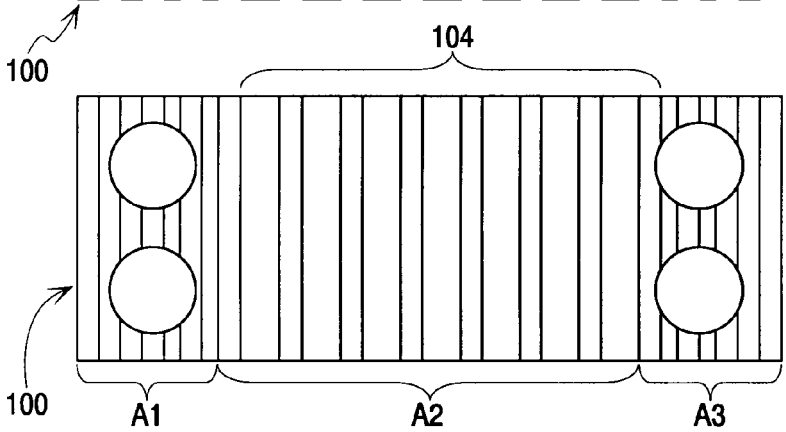

FIGS. 4*a*–4*b* illustrate yet another insert 100 embodying the present invention, wherein the trough lengths are longer than the crest lengths only in the central portion 104 of the insert 100. Such an insert 100 is illustrated within a suitable tube 20 in FIG. 5. Specifically, the insert 100 may include first and third sections A1, A3 each having several waves with substantially equal wavelengths, with a middle section A2 having longer wavelengths. A larger wavelength of the insert leads to a smaller pressure loss. It would, however, be within the scope of the invention to provide different wavelengths in the first section A1 than in the third section A3. Moreover, the length of the sections A1, A2, A3 may also be freely chosen according to the specific application of the insert 100.

Figure 6:
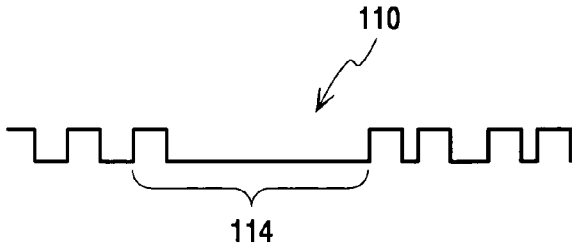
FIG. 6 is a side view of yet another embodiment of an insert according to the present invention.

FIG. 6 illustrates still another insert 110 embodying the present invention. With this insert 110, a middle portion 114 may be provided which may be characterized as a portion with a long wavelength having a significantly longer trough than crest.

Inserts according to the present invention may be advantageously produced on a press in a punching die, for example, from an "endless" sheet material (advantageously aluminum) such as is generally well known in the prior art. That is, the metal sheet may be transported with a specific constant feed rate over the entire insert from a so-called coil and through the punch die, in order to produce an insert according to the prior art.

Figure 3A:
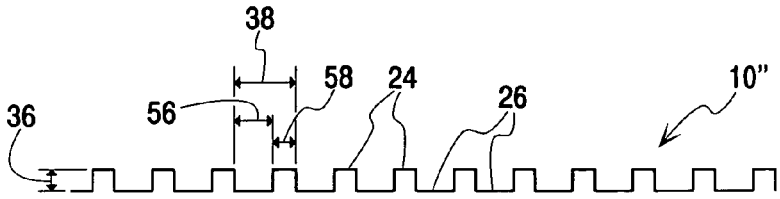
FIGS. 3*a*–3*b* are side and top views of an embodiment of an insert according to the present invention.
Figure 3B:
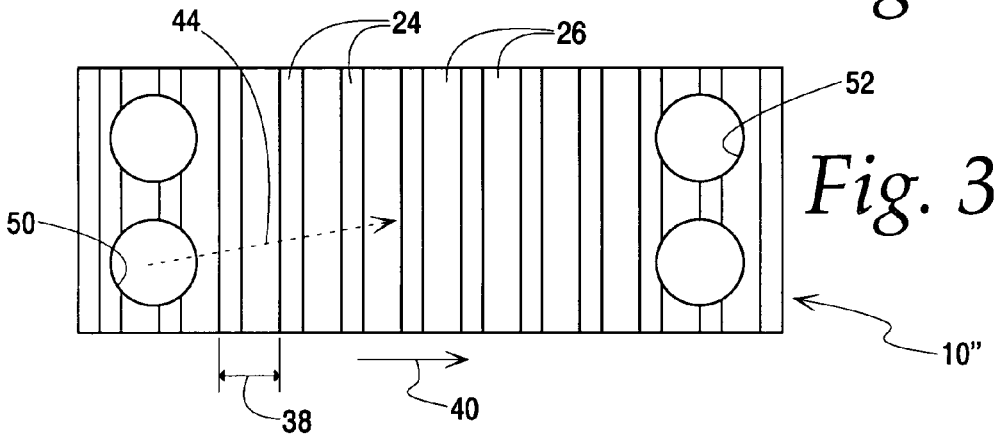

The insert 10" of FIGS. 3*a*–3*b* may be advantageously produced using a feed rate of the metal sheet which is also constant, but higher than in the prior art, whereby the wavelength, and trough length, may be increased.

In the production of the insert 100 according to FIGS. 4*a*–5, the feed rate is varied in intervals. Initially, the first section A1 (see FIG. 4*b*) is produced with a constant but relatively slow sheet feed speed. The middle section A2 is then produced with a constant but relatively higher sheet feed rate, or with increased advance, and then the third section A3 is produced with a constant but relatively slow speed (e.g., at the speed used during the production of the first section A1, where similar wavelengths are desired in the first and third sections A1, A3). While the precise sheet feed speeds to use for the production of a particular configuration insert may be determined via trial and error or by design, it should be recognized that a higher speed or larger advance leads to larger wavelengths, whereas reduced speed leads to smaller wavelengths.

The same result may also be achieved by varying the continuous stroke speed of the press instead of the feed rate of the material sheet. For example, according to FIGS. 4*a*–5, section A1 can be produced with a continuous stroke speed of 240 strokes per minute, the following section A2 (which has larger wavelengths), can be produced with 200 strokes per minute, and the end section A3 can again be produced with 240 strokes per minute. However, it should be recognized that the variation of feed rate or advance of the material sheet will not require potentially undesirable frequent changing of the continuous stroke speed which may burden the press mechanism.

Desired variations of continuous stroke, advance and/or feed rate may be provided in any suitable manner, including by preprograming a programming unit connected to the press.

A press stroke may be characterized as a 360° full circle rotation of the eccentric shaft of the press, in which the deformation operation occurs at bottom dead center (i.e., in the region of 180°). The sheet advance, for example, may occur within an angle position of the eccentric shaft between 320° and 40° (i.e., within an 80° angular path), passage through which (over top dead center) is assigned to a certain period according to the adjusted continuous stroke speed, within which the advance can occur. By corresponding control, a situation may be advantageously achieved in which sheet advance occurs, for example, within a 100° angular path (i.e., between 310° and 50°), which permits a longer period within which a larger path or a larger advance is allowed at the same feed rate, producing longer wavelengths at the same constant lift speed.

The limits of the angular positions, within which the advance can be carried out, can be different from case to case. These depend, among other things, on the diameter of the eccentric shaft and on the depth of engagement of the upper die into the lower die. If this depth is small and the diameter large, broader limits can be considered accordingly. A larger angular path (arc scale) than 180° (i.e., between 270° and 90°) appears to be rarely achievable, however. Maximized advances may be advantageously attained if, in addition to lengthening of the angular path, the feed rate is simultaneously increased.

The insert 110 of FIG. 6, with a middle section 114 with a single long drawn-out wave, may be advantageously produced by interrupting continuous stroke operation of the eccentric press with continuing advance of the material sheet. By this manner, an insert that has a section 114 of arbitrary length, in which essentially no waves are present (or only a single long wave) can be produced which is therefore flat. At least one section with waves may precede such a section 114, and at least one section with waves may be connected to the flat section 114. Such designs of corrugated inserts may be advantageously used in many cases to avoid the use of several individual inserts.

It should thus be appreciated that in accordance with the invention, a corrugated insert can be advantageously produced at low cost, with the insert assisting in providing an optimized ratio of cooling performance to pressure loss in a heat exchanger. Moreover, an advantageous production method for such inserts is provided. Further, the use of longer wavelengths/longer crests and/or troughs can provide a not insignificant material savings.

It should also be appreciated that various inserts embodying the present invention may be produced with little or no changes in the punching die. Only the speed of sheet advance, or alternatively the continuous stroke speed of the press or the size of the advance, must be selected, in order to obtain the desired form of the insert. Larger or smaller advances can be accomplished by changing the angular positions of the eccentric shaft of the press, between which advance can occur.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. An insert adapted to connect to opposite walls in a heat exchanger tube, said insert comprising a corrugated sheet having alternating wave crests and wave troughs connected by wave flanks having openings therein, said insert having a first section having a first wavelength with a direction of propogation and a second section having a second wavelength with a direction of propogation that is the same as the direction of propogation for said first wavelength, said first section being adjacent said second section and said first wavelength being less than the second wavelength.

2. The insert of claim 1, further comprising a third section having a third wavelength, said second section being between said first and third sections with said second wavelength being greater than said first and third wavelengths.

3. An insert adapted to connect to opposite walls in a heat exchanger tube, said insert comprising a corrugated sheet having alternating wave crests and wave troughs connected by wave flanks having openings therein, said insert having a first section having a first wavelength and a second section having a second wavelength, said first section being adjacent said second section and said first wavelength being less than the second wavelength, further comprising a third section having a third wavelength, said second section being between said first and third sections with said second wavelength being greater than said first and third wavelengths and further comprising a heat exchanger medium inlet opening in said first section and a heat exchanger medium outlet opening in said third section, wherein said first and third wavelengths are substantially the same.

* * * * *